US011268224B1

(12) United States Patent
Frost

(10) Patent No.: US 11,268,224 B1
(45) Date of Patent: Mar. 8, 2022

(54) APPARATUS AND METHOD FOR MANUFACTURING MASKS

(71) Applicant: Aviram F Industries Ltd., Balfouria (IL)

(72) Inventor: Aviram Frost, Balfouria (IL)

(73) Assignee: AVIRAM F INDUSTRIES LTD., Balfouria (IL)

( * ) Notice: Subject to any disclaimer, the term of this patent is extended or adjusted under 35 U.S.C. 154(b) by 0 days.

(21) Appl. No.: 17/363,044

(22) Filed: Jun. 30, 2021

Related U.S. Application Data

(63) Continuation of application No. 17/160,446, filed on Jan. 28, 2021.

(51) Int. Cl.

| | |
|---|---|
| ***D05B 33/02*** | (2006.01) |
| ***D05B 35/00*** | (2006.01) |
| ***B65H 39/16*** | (2006.01) |
| ***B65H 37/04*** | (2006.01) |
| ***D06H 5/00*** | (2006.01) |
| *A41D 13/11* | (2006.01) |
| *A41H 43/04* | (2006.01) |

(52) U.S. Cl.
CPC ..... *D05B 33/02* (2013.01); *B65H 37/04* (2013.01); *B65H 39/16* (2013.01); *D05B 35/00* (2013.01); *D06H 5/00* (2013.01); *A41D 13/1123* (2013.01); *A41D 2500/30* (2013.01); *A41H 43/04* (2013.01); *D05D 2305/02* (2013.01); *D05D 2305/04* (2013.01); *D10B 2501/042* (2013.01)

(58) Field of Classification Search
None
See application file for complete search history.

(56) References Cited

U.S. PATENT DOCUMENTS

| | | | | |
|---|---|---|---|---|
| 5,322,061 A * | 6/1994 | Brunson | ..... | A41D 13/1115 128/206.13 |
| 6,173,712 B1 * | 1/2001 | Brunson | ..... | A62B 23/025 128/206.19 |
| 10,494,221 B2 * | 12/2019 | Harris | ..... | B65H 69/00 |

FOREIGN PATENT DOCUMENTS

| | | | |
|---|---|---|---|
| CN | 111802738 A | * | 10/2020 |
| CN | 111820515 A | * | 10/2020 |
| CN | 112315052 A | * | 2/2021 |
| CN | 112385926 A | * | 2/2021 |
| CN | 112537039 A | * | 3/2021 |

* cited by examiner

*Primary Examiner* — Leslie A Nicholson, III
(74) *Attorney, Agent, or Firm* — Pearl Cohen Zedek Latzer Baratz LLP

(57) ABSTRACT

An apparatus for manufacturing trapezoid-shaped masks is disclosed. The apparatus may include, a first feeding unit, for providing three or more rolled fabrics; a second feeding unit, for providing one or more rolled materials, simultaneously to the provision of the three or more rolled fabrics; a first folding and joining unit, for folding and joining together edges of three or more fabrics provided by the first feeding unit to form a joint multilayered fabric; a second folding and joining unit, for folding and joining the edges of one or more materials provided by the second feeding unit to form folded material; and a joining unit configured to join together the joint multilayered fabric and the folded material, by forming the continuous joint thereby forming at least two masks in relatively alternating positions, such that the open side of one mask is pointing in an opposite direction from the open side of the other mask.

20 Claims, 5 Drawing Sheets

APPARATUS AND METHOD FOR MANUFACTURING MASKS

CROSS-REFERENCE TO RELATED APPLICATIONS

This Application is a continuation of U.S. application Ser. No. 17/160,446, filed on Jan. 28, 2021, which is incorporated herein by reference in its entirety.

FIELD OF THE INVENTION

The present technology relates to an apparatus and a method for manufacturing masks. More specifically, the present invention is related to an apparatus and a method for manufacturing trapezoid masks.

BACKGROUND OF THE INVENTION

Trapezoid protective face masks, also known in the art as duck-billed face masks, are widely used. The N-95 version of these masks became very popular during the COVID-19 pandemic, since it provides both good antiviral protection to the user and relatively comfortable breathing. The structure of the mask, two halves that look more or less identical and create a crease in the middle, provides extra room between the mouth and the fabric.

The disposable N-95 duck-billed face masks are usually made from a multilayered fabric that includes at least three layers, two external layers and one or more internal filtering layers. The masks are made in mass production, are relatively costly in comparison to other disposable masks and have a single design, two identical halves connected in the middle. The relatively high costs of these masks are due to two major factors, (1) the use of more expensive fabrics and (2) large amount of waste in comparison to the rectangular mask.

Accordingly, there is a need for a manufacturing device and method that may allow cost effective manufacturing of trapezoid masks. Such a device may further allow greater manufacturing flexibility using various and different materials.

SUMMARY OF THE INVENTION

Some aspects of the invention may be directed to an apparatus for manufacturing trapezoid-shaped masks. Each trapezoid-shaped mask may include an opening along a wide base of the trapezoid and a continuous joint along two sides and a narrow base of the trapezoid joining two portions of the mask. In some embodiments, the apparatus may include, a first feeding unit, for providing three or more rolled fabrics; a second feeding unit, for providing one or more rolled materials, simultaneously to the providing the three or more rolled fabrics; a first folding and joining unit, for folding and joining together edges of three or more fabrics provided by the first feeding unit to form a joint multilayered fabric; a second folding and joining unit, for folding and joining the edges of one or more materials provided by the second feeding unit to form a folded material; and a joining unit configured to join together the joint multilayered fabric and the folded material, by forming the continuous joint thereby forming at least two adjacent masks in relatively alternating positions, such that the open side of one mask is pointing in an opposite direction from the open side of the adjacent mask.

In some embodiments the apparatus may further include one or more metal wire insertion units, each comprising: a continuous metal wire reservoir providing metal wire; and a metal wire alignment unit located prior to the first and second folding and joining units, configured to place the metal wire such that upon folding the metal wire is located inside the folded edge. In some embodiments the apparatus may further include one or more cutters for cutting each metal wire to a predetermined length, during the placement of metal wire.

In some embodiments, the at least two masks are continuously joined simultaneously. In some embodiments, the three or more fabrics are selected from: nonwoven fabric and filtering fabric. In some embodiments, the one or more rolled material is selected from: nonwoven fabric, filtering fabric and a transparent elastomer.

In some embodiments, the apparatus may further include, a first aligning unit for aligning the three or more rolled fabrics prior to folding and joining; and a second aligning unit for aligning the one or more rolled materials prior to folding and joining.

In some embodiments, the apparatus may further include two pad adding units, configured to add at least one pad to an inner portion of the folded open wide base of each mask. In some embodiments, the apparatus may further include one or more cutting units configured to cut the joint masks.

In some embodiments, the apparatus may further include one or more bands connecting units, configured to add bands from both sides of each cut mask, located prior to the joining unit, such that upon joining each mask the bands are located between the joint fabric and the one of more folded materials and held by the joint.

In some embodiments, the apparatus may further include the joining unit may include ultrasonic welding rolls, at least one being patterned with a pattern containing the continuous joints forming the at least two masks. In some embodiments, the joining unit may include adhesive material providing unit for providing adhesive material to glue the joint multilayered fabric and the folded material to form the continuous joints forming the at least two masks. In some embodiments, the joining unit may include sewing unit for stitching together the joint multilayered fabric and the folded material to form the continuous joint forming the at least two masks. In some embodiments, the joining unit may include a stamping unit for stamping together the joint multilayered fabric and the folded material to form the continuous joint forming the at least two masks. In some embodiments, the joining unit may include a press unit having at least one surface patterned with a pattern containing the continuous joint forming the at least two masks.

In some embodiments, the first and second feeding units are horizontally aligned one above the other. In some embodiments, the first and second feeding units are vertically aligned one next to the other. In some embodiments, the first and second feeding units are horizontally aligned, one above and one below the first and second folding and joining units. In some embodiments, the first and second feeding units are included in a single feeding unit.

Some additional aspects of the invention may be directed to a method of manufacturing trapezoid-shaped masks, each mask comprising an open along a wide base of the trapezoid and a continuous join along two sides and a narrow base, the method may include: providing three or more rolled fabrics, by a first feeding unit; providing one or more rolled materials, by a second feeding unit, simultaneously to the provision of the three or more rolled fabrics; folding and joining together edges of three or more fabrics to form a joint multilayered fabric, using a first folding and joining unit; folding and joining the edges of one or more materials, using a second folding and joining unit; joining together the joint multilayered fabric and the folded material, using a joining unit, by forming the continuous joint in alternating positions, such that the open side of one mask is pointing in an opposite direction from the open side of the other mask.

In some embodiments, the method may further include inserting two metal wires to the folded edges of the joint multilayered fabric, using two insertion units, by a continuous provision of metal wires from two metal wire reservoirs; and placing the metal wires such that upon folding the metal wires are located inside the folded edge. In some embodiments, the method may further include cutting each metal wire to a predetermined length, prior to the placement of metal wire.

In some embodiments, the joining of the at least two masks is preformed simultaneously.

In some embodiments, the method may further include, aligning the three or more fabrics prior to folding and joining, using a first aligning unit; and aligning the one or more materials prior to folding and joining, using a second aligning unit.

In some embodiments, the method may further include adding at least one pad to an inner portion of the folded open wide base of each mask, using two pad adding units. In some embodiments, the method may further include cutting the joint masks, using one or more cutting units. In some embodiments, the method may further include adding bands from both sides of each cut mask, using one or more bands connecting units located prior to the joining unit, such that upon joining each mask the bands are located between the joint fabric and the one of more folded materials and held by the joint.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
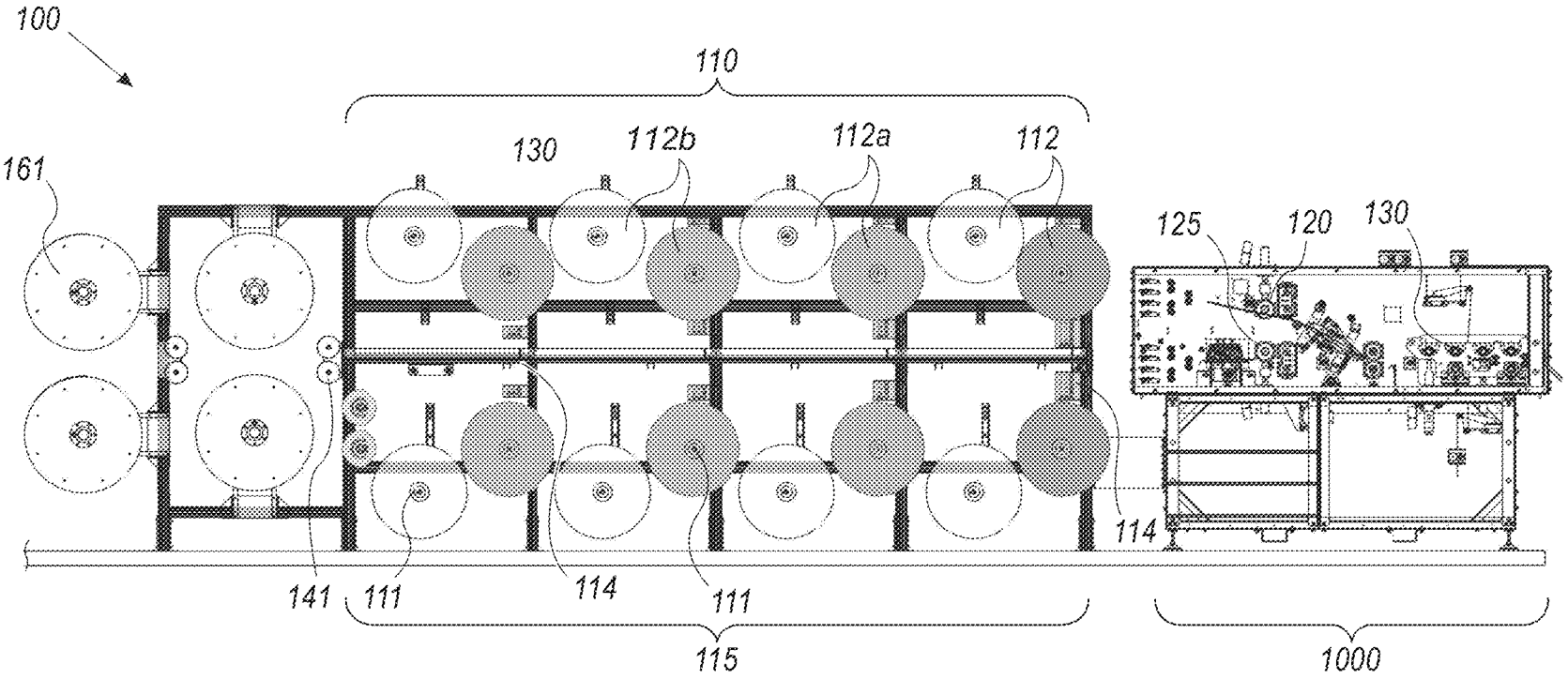
FIGS. 1A and 1B are illustrations of an apparatus for manufacturing trapezoid-shaped masks according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components, modules, units and/or circuits have not been described in detail so as not to obscure the invention. Some features or elements described with respect to one embodiment may be combined with features or elements described with respect to other embodiments. For the sake of clarity, discussion of same or similar features or elements may not be repeated.

Some aspects of the invention may be directed to a method and an apparatus for manufacturing trapezoid masks (e.g., duck-billed face masks). An apparatus according to embodiments of the invention may be relatively compact and easy to deliver from one site to another. For example, the apparatus may be inserted into a standard commercial container of a truck. Therefore, the apparatus can easily be moved from one production site to another. Furthermore, such an apparatus may require the provision of electricity only, thus can be plugged in at any site. For example, a hospital that needs a limited number of N-95 masks (e.g., 20,000 pieces) can request a delivery of the apparatus to a location near the hospital, plug the apparatus into the electric grid, and start producing the required number of masks.

Using an apparatus and manufacturing method according to some embodiments of the invention may result in a very low amount of waste, due to a novel arrangement of the masks during the joining step of mask elements, in relatively alternating positions, as discussed and explained herein below with respect to FIG. 3A. Therefore, in some embodiments, the reduction of waste may allow producing cheaper masks and may raise the commercial profitability of production of relatively small batches.

As used herein a trapezoid mask, also known in the art as duck-billed face mask, may include any mask having a lower trapezoidal portion and an upper trapezoidal portion connected together via a continuous joint along two sides and a narrow base of the trapezoid and an opening along a wide base of the trapezoid.

Figure 1B:
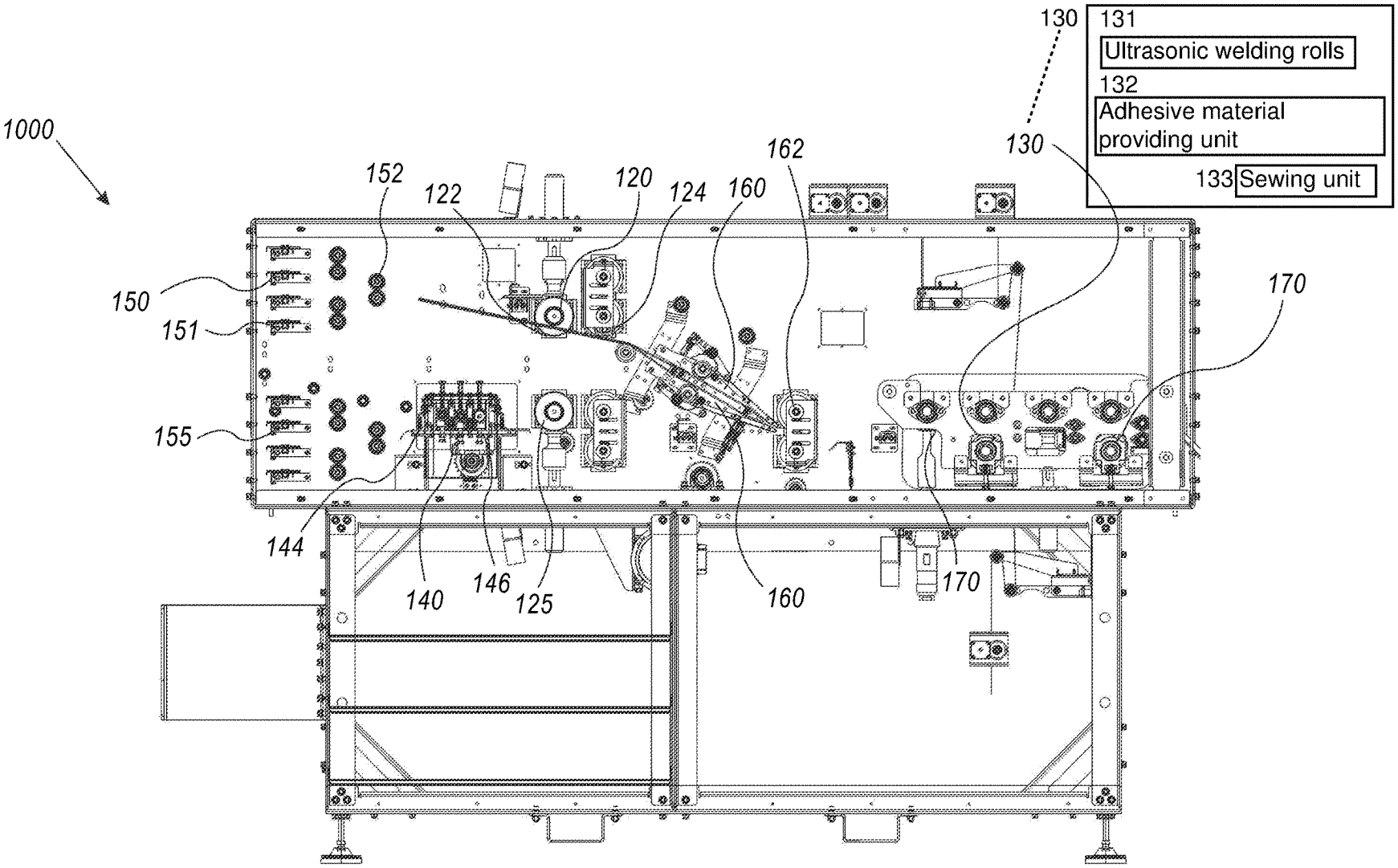

Reference is now made to FIGS. 1A and 1B which are schematic illustrations of apparatus 100 for manufacturing trapezoid masks, according to embodiments of the invention. FIG. 1A is an illustration of the entire system and FIG. 1B is an enlarged illustration of section 1000 of apparatus 100 depicting some of the components of the apparatus in more details. An apparatus 100 according to some embodiments of the invention may be used for manufacturing trapezoid masks (e.g., mask 300 illustrated in FIG. 3B) or any other forms of masks, for example, semi-spherical masks. Apparatus 100 may include a first feeding unit 110, for providing three or more rolled fabrics and a second feeding unit 115, for providing one or more rolled materials, preferably simultaneously to the provision of the three or more rolled fabrics. In some embodiments, first feeding unit 110 and second feeding unit 115 may each include one or more rolling cylinders 111 for carrying rolls 112, 112*a* and 112*b* of fabrics and/or rolls of other materials. Rolling cylinders 111 may provide and guide the fabrics and materials for manufacturing the masks. In some embodiments, each of rolling cylinders 111 may be powered by one or more electric motors 114.

In some embodiments, first feeding unit 110 and second feeding unit 115 may be horizontally aligned one above the other, as illustrated in FIG. 1A. In some embodiments, first and second feeding units 110 and 115 may be located in a single housing. In some embodiments, first and second feeding units 110 and 115 may be vertically aligned one next to the other. In some embodiments, first and second feeding units 110 and 115 may be horizontally aligned, one above and one below first and second folding and joining units 120, 125.

In some embodiments, rolls 112, 112*a* and 112*b* of first feeding unit 110 may each include a rolled fabric or other rolled materials. In some embodiments, pairs of rolls may be included (as illustrated) for continuous provision of one rolled material or one type of rolled fabric. For example, when the material in a first roll is finished, the other roll may automatically start to provide the material. In some embodiments, rolls 112 may both include the material for the outer layer of a mask, for example, nonwoven Spunbond polypropylene (PP). In some embodiments, rolls 112*a* may include material for an inner layer of the mask (i.e., the layer touching the face of the user), for example, nonwoven Spunbond/Meltblown/Spunbond (SMS) PP. In some embodiments, rolls 112*b* may include the material for a filtering layer or layers (e.g., four rolls providing a filtering fabric for two layers illustrated in FIG. 1A). In some embodiments, second feeding unit 115 may provide the same materials as rolls 112, 112*a* and 112*b* of first feeding unit 110, as illustrated. In some embodiments, second feeding unit 115 may include rolls with different materials, for example, a transparent elastomer.

In some embodiments, the three or more rolled fabrics may include nonwoven fabric, nonwoven filtering fabric, woven fabric, and the like. A nonlimiting specific example, for nonwoven filtering fabric (e.g., roll 112*b*) may include nonwoven polypropylene (PP) having a density of 0.88-0.913 g/cm$^3$ at 23° C. approved by the FDA as suitable for N-95 masks (FDA 21 CRF 177.1520). Another nonlimiting example for nonwoven filtering fabric may include melt-blown-cloth made from PP having filtering efficiency of NaCl particles of 98.7% according to GB standard 2626-2006 6.3. As would be understood by one skilled in the art, the listed nonwoven fabrics are given as examples only and device 100 and feeding units 110 and 115 can be provided with any suitable fabrics/materials.

In some embodiments, one portion (e.g., an upper half) of the trapezoid mask may be transparent. In such case a rolled transparent polymer may be provided to feeding unit 115, for example, a transparent elastomer, such as, biaxially oriented polypropylene. In some embodiments, feeding unit 115 may be fed with one or more (e.g., three or four) fabrics, such as those listed above. As used herein, upper portion or upper half, and lower portion or lower half are defined with respect to a placement of the mask on a user's face, where the upper portion faces the upper part of the wearer's face.

In some embodiments, unit 1000 of apparatus 100 may include a first folding and joining unit 120, for folding and joining together edges of three or more fabrics (e.g., strips of fabrics) provided by unit 110 to form a joint multilayered fabric (e.g., joint fabric 305 illustrated in FIG. 3B) and a second folding and joining unit 125, for folding and joining the edges of one or more materials (e.g., strip(s) of material(s)) provided by unit 115. Each one of folding and joining unit 120 and 125 may include folding element 122 (e.g., funnels) and joining rolls 124. For example, joining may be done by ultrasonic welding of the folded edges. In some embodiments, other joining methods can be applied for joining the folded edges, for example, gluing, stitching, stamping and the like.

In some embodiments, unit 1000 may further include a joining unit 130 configured to join together the joint multilayered fabric and the folded material, by forming a continuous joint line forming at least two masks in alternating relative positions, such that an open side of one mask is pointing in an opposite direction from the open side of the other mask. An illustration of such a positioning and the location of the continuous joint line and folded joint edges is given and discussed with respect to FIGS. 3A and 3B.

Joining unit 130 may include any unit, device or component that may be required to allow unit 130 to form the continuous joint line between the joint fabric (e.g. Joint fabric 305) and the folded one or more materials. For example, joining unit 130 may include rolls 131 provided with ultrasonic welding means, at least one of them being patterned with a pattern containing the continuous joints line configured to form the at least two masks. A nonlimiting example of such patterned roll is given in FIGS. 2*a* and 2*b*. In another example, joining unit 130 may include unit 132 adapted to provide adhesive material for providing adhesive material to glue the joint multilayered fabric and the folded material to form the continuous joint lines forming the at least two masks. In yet another example, joining unit 130 may include a sewing unit 133 for stitching together the joint multilayered fabric and the folded material to form the continuous joint forming the at least two masks. In yet another example, joining unit 130 may include a stamping unit for stamping together the joint multilayered fabric and the folded material to form the continuous joint forming the at least two masks. In yet another example, joining unit 130 may include a press unit having at least one surface patterned with a pattern containing the continuous joint forming the at least two masks. In some embodiments, joining unit 130 may be configured to join the at least two masks simultaneously or sequentially.

In some embodiments, apparatus 100 may include one or more metal wire insertion units 140. Each one of metal wire insertion units 140 may include a continuous metal wire reservoir 141 (illustrated in FIG. 1A) and a metal wire alignment unit 144 located prior to first and second folding and joining units 120 and 125 with respect to the masks production direction. In some embodiments, wire insertion units 140 may be configured to place the metal wire such that upon folding the three or more fabrics or the material the metal wire is located between the folded edge and the portion of fabric facing the folded edge. In some embodiments, each one of units 140 may include a cutter 146 for cutting each metal wire to a predetermined length (e.g., metal wire 320 illustrated in FIGS. 3A and 3B), during the placement of metal wire. For example, unit 140 may include two metal rolls configured to push the wire into a tunnel-like-structure to be cut by a guillotine. In another example, unit 140 may include two metal rolls configured to push the wire towards a cutting knife.

In some embodiments, apparatus 100 may further include a first aligning unit 150 for aligning the three or more rolled fabrics prior to folding and joining, and a second aligning unit 155 for aligning the one or more rolled materials prior to folding and joining. For example, aligning units 150 and 155 may include guiding rails 151 and guiding rolls 152 that are adapted to combine and align the three or more fabrics together and the one or more materials together, respectively.

In some embodiments, apparatus 100 may further include two pad adding units 160, configured to add at least one pad (e.g., pad 325 illustrated in FIG. 3A) to an inner portion of the folded open wide base of each mask. As used herein, the inner portion of the open wide base is the portion of the mask perimeter touching the user's face. For example, each pad adding units 160 may include a reservoir of rolled pad material 161 (illustrated in FIG. 1A) that may include an adhesive layer attached to one face of the pad. The pad may include a soft flexible polymer (e.g., a polyethylene foam and the like). In some embodiments, pad adding units 160 may be an attachment unit 162 configured to attach (e.g., using glue) the adhesive face of the pad to the inner portion (i.e., the folded edge) of at least one open wide base of each mask. In some embodiments, pad adding units 160 may include a cutter (e.g., a hot pin, not illustrated) for cutting each pad to a desired length.

In some embodiments, unit 1000 may further include one or more cutting units 170 configured to cut apart the joined masks. For example, cutting unit 170 may include, cutting patterned cylinder, a laser cutter, a knife and the like.

In some embodiments, apparatus 100 may further include one or more bands (e.g. elastic bands) connecting units 180, configured to add bands (e.g., bands 330 illustrated in FIG. 3B) from both sides of each mask. In some embodiments, bands connecting units 180 may be located in apparatus 1000 direction of the mask production, prior to reaching joining unit 130, such that upon joining the layers of each mask, the bands are located between the joint fabric and the one of more folded materials and held by the continuous joint. In some embodiments, bands connecting units 180 may be configured to provide for each two masks two elastic bands simultaneously, to a total of four elastic bands. Each band connecting units 180 may include 4 rolls of elastic bands and four cutters for cutting the bands to a desired length.

In some embodiments, apparatus 100 may further include a controller (not shown) for controlling, the various elements and units of device 100. The controller may be configured to control the provision speed of the rolled fabrics and rolled material, the provision speed of the metal wire, the pads, the manufacturing speed of each unit and the like. The controller may further be configured to set the timing for each cutting action based on the manufacturing speed.

Figure 2A:
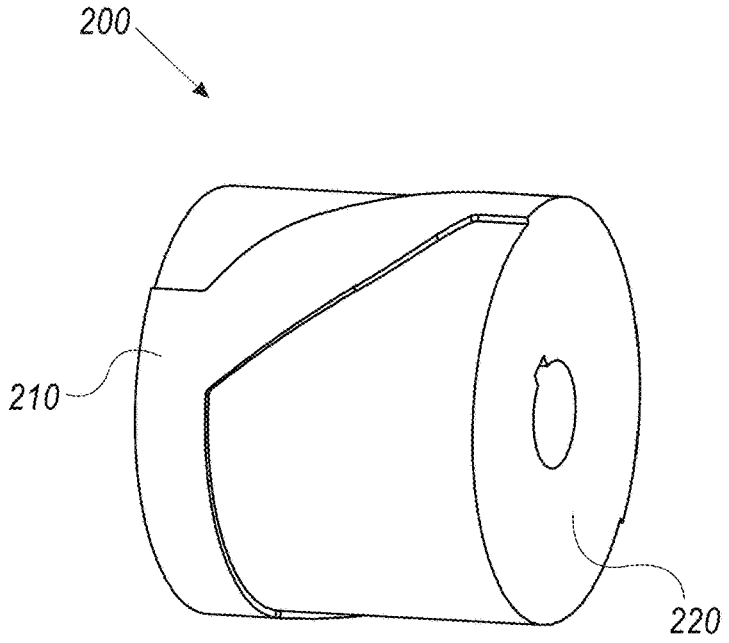
FIGS. 2A and 2B are illustrations of a patterned ultrasonic welding unit according to some embodiments of the invention.
Figure 2B:
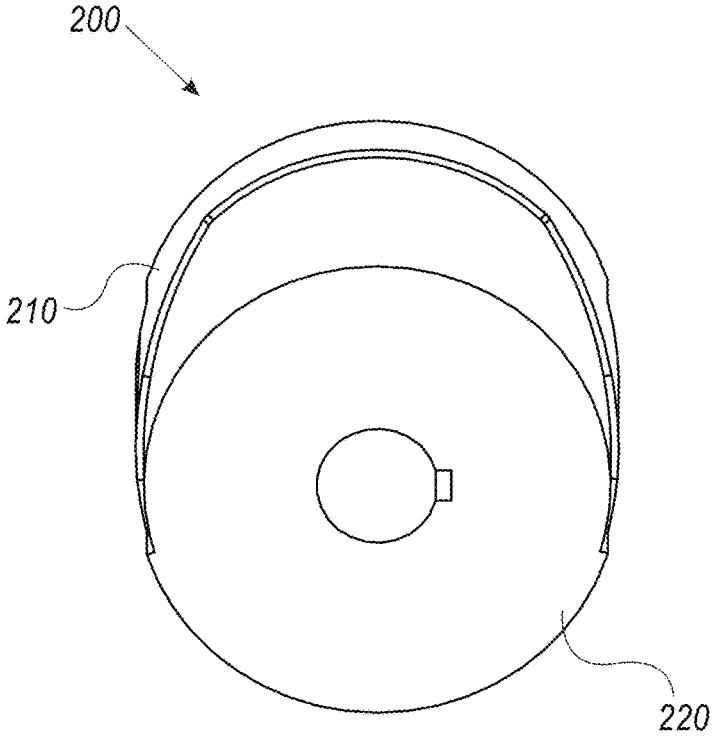

Reference is now made to FIGS. 2A and 2B which are illustrations of two views of a nonlimiting example for a patterned cylinder for joining unit 130, according to some embodiments of the present invention. A patterned cylinder 200 may include a patterned embossment 210 and a body 220. Patterned embossment 210 is configured to deliver US waves to the joint fabric and the folded material thereby to form a welded continuous joint.

Figure 3A:
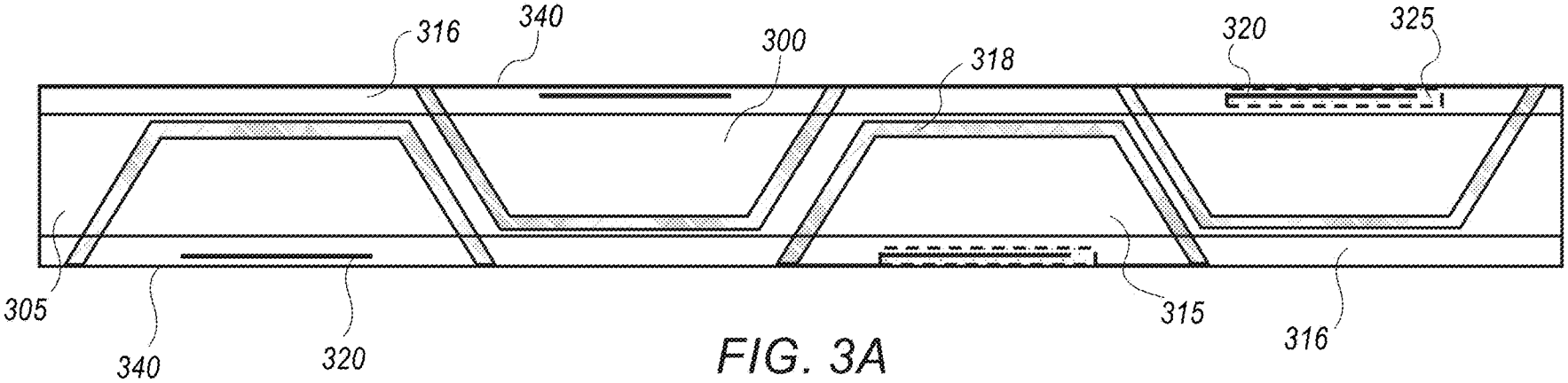
FIG. 3A is an illustration of positioning of masks on provided joint fabric during production, according to some embodiments of the invention.
Figure 3B:
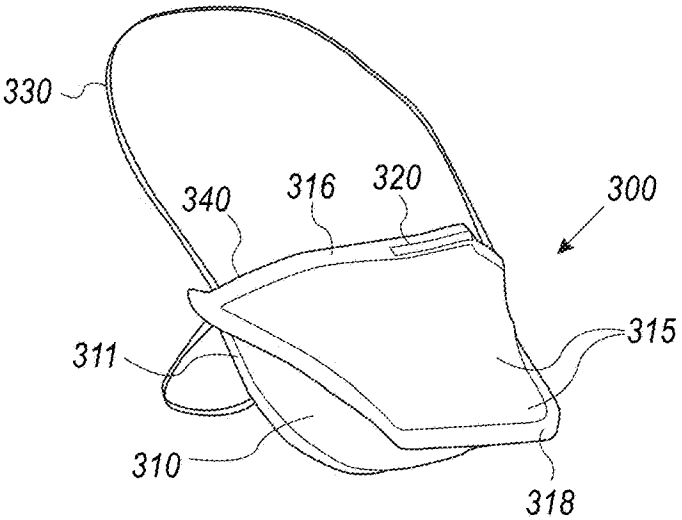
FIG. 3B is an illustration of a trapezoid mask according to some embodiments of the invention.

Reference is now made to FIG. 3A which is a schematic illustration of a top view of folded and joined fabrics and materials as shown during certain stages of the production process, which are illustrated and discussed in FIGS. 1A, 1B,2A and 2B, prior to cutting the masks, according to some embodiments of the invention. In the top view illustrated in FIG. 3A only an upper portion 315 (e.g., upper half) of each trapezoid mask 300 is shown. Lower portion 310 is illustrated in FIG. 3B. As used herein, upper portion and lower portions are defined with respect to a placement of the mask of a user's face, where the upper portion faces the upper part of the wearer's face. The upper portion of the mask includes a metal wire for tightly adjusting the mask's upper edge to the bridge of the user's nose. As can be seen in FIG. 3A, folded material or joint fabric 305 may include two folded edges 316 made on two sides of the materials' strip. Folded material 305 may include a single material, for example, a transparent elastomer or a multilayer joint fabric that includes several (e.g., 3, 4, 5 or more) different fabrics. In some embodiments, continuous joints 318 may form masks 300 (e.g., the 4 masks illustrated) in relative alternating positions, such that an open side 340 of one mask 300 is pointing in an opposite direction from an open side 340 of another mask 300.

In some embodiments, the upper portion of each mask 300 may include a wire 320 inserted inside folded edge 316 of folded material 305, such that each mask 300 may include a single wire 320. In some embodiments, upper portion 315 of each mask 300 may include a pad 325 located at an inner portion of the folded open wide base 340 of each mask, when the mask is worn by the user. Pad 325 is shown in dashed line, representing the location at which the pad is attached, at the bottom side of portion 315.

Reference is now made to FIG. 3B which is an illustration of trapezoid mask 300 at the end of the production line. Mask 300 may include a lower trapezoid portion 310 and an upper trapezoid portion 315 connected together via a continuous joint 318 along two sides and a narrow base of the trapezoid and an open 340 along a wide base of the trapezoid. Mask 300 may further include a wire 320 located inside folded edge 316 of upper portion 315. In some embodiments, lower portion 310 may include a folded edge 311. In some embodiments, mask 300 may further include two elastic bands 330 for securing mask 300 to the face of the user.

A nonlimiting selection of materials for each of the elements of mask 300 is given in table 1.

TABLE 1

| Element | structure | materials | specification |
|---|---|---|---|
| Lower portion 310 | Inner layer | Spunbond/Meltblown/ Spunbond (SMS) PP | 20 g/m2 |
| | Two filtering layers | Meltblown PP | 25 g/m2 |
| | Outer layer | Spunbond PP | 50 g/m2 |
| Upper portion 315 | Inner layer | Spunbond/Meltblown/ Spunbond (SMS) PP | 20 g/m2 |
| | Two filtering layers | Meltblown PP | 25 g/m2 |
| | Outer layer | Spunbond PP | 50 g/m2 |
| Wire 320 | Diameter 1 mm | Hot dipped galvanized steel wire | 8.92 gr/m |

TABLE 1-continued

| Element | structure | materials | specification |
|---|---|---|---|
| Elastic bands 330 | | Blue thermoplastic polyurethane | Thickness: 500 micron<br>Width 6 mm |
| Pad 325 | | Cross-linked polyethylene | Length: 115 mm<br>Width: 15 mm<br>Thickness: 3 mm |

Figure 4:
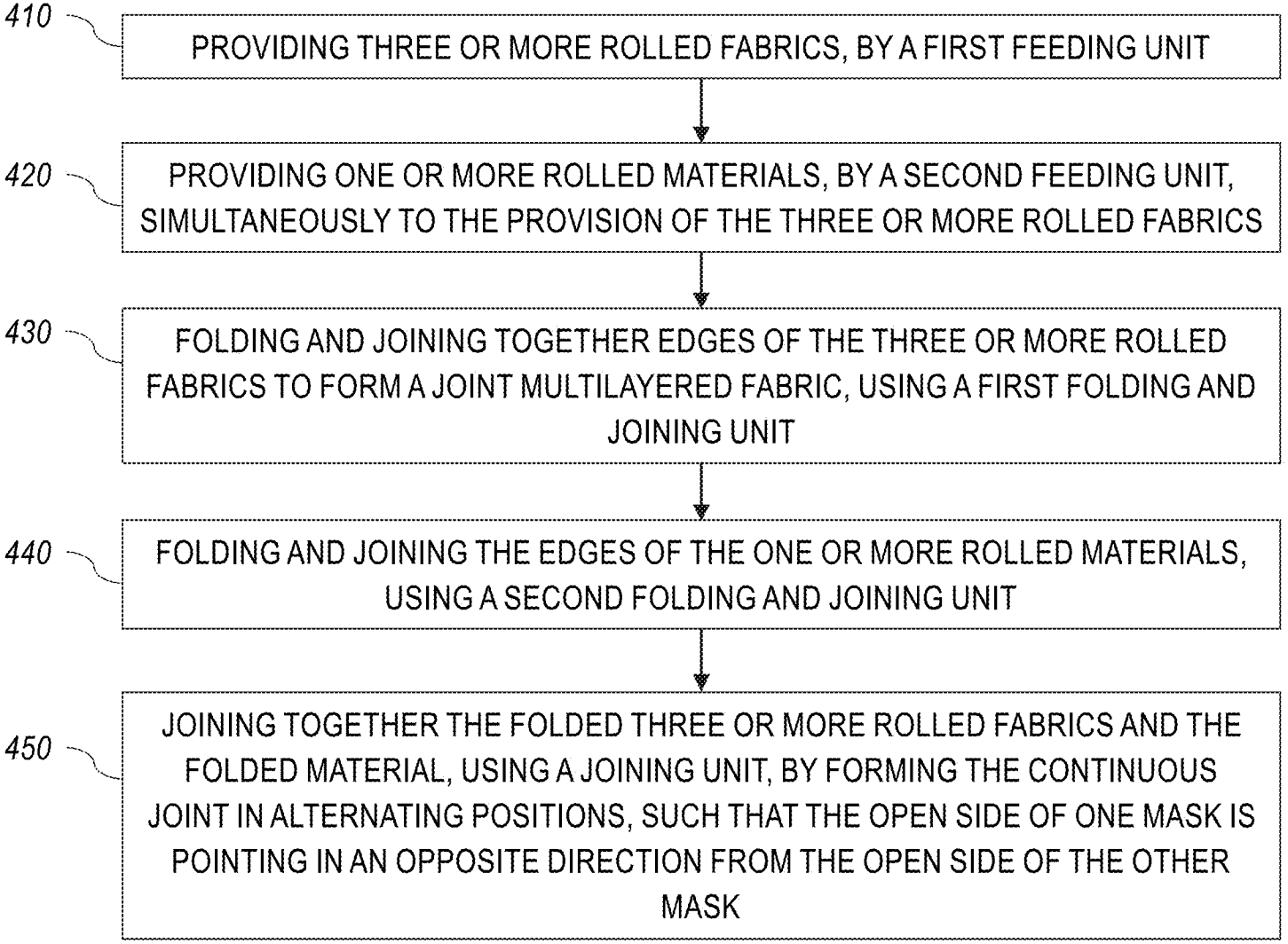
FIG. 4 is a flowchart of a method of manufacturing trapezoid masks according to some embodiments of the invention.

Reference is now made to FIG. 4 which is a flowchart of a method of manufacturing trapezoid masks, each mask comprising an opening along a wide base of the trapezoid and a continuous joint along two sides and a narrow base of the trapezoid, according to some embodiments of the invention. In step 410, three or more rolled fabrics may be provided, by a first feeding unit. For example, three or more rolled fabrics from rolls 112, 112*a* and 112*b* may be provided by first feeding unit 110. In step 420, one or more rolled materials may be provided, by a second feeding unit, preferably simultaneously to the provision of the three or more rolled fabrics. For example, three or more rolled fabrics from rolls 112, 112*a* and 112*b* may be provided by second feeding unit 115. Alternatively, a transparent elastomer may be provided by second feeding unit 115.

In step 430, edges of the three or more rolled fabrics may be folded and joined together to form a joint multilayered fabric, using a first folding and joining unit. For example, rolled fabrics from rolls 112, 112*a* and 112*b* may be folded and joined together to all the edges of three or more rolled fabrics from rolls 112, 112*a* and 112*b* may be folded together and joined to form fabric 305, using first folding and joining unit 120. In step 440, the edges of the one or more rolled materials may be folded and joined together, using a second folding and joining unit. For example, all the edges of three or more rolled fabrics from rolls 112, 112*a* and 112*b* may be folded together and joined to form another joint multilayer fabric 305 using unit 125. Alternatively, the edge of a transparent elastomer may be folded and joined using unit 125.

In step 450, the joint multilayered fabric and the folded material may be joined together, using a joining unit, by forming the continuous joint in alternating positions, such that the open side of one mask is pointing in an opposite direction from the open side of the other mask. For example, two joint multilayer fabrics 305 may be joined together, using joining unit 130, by forming the continuous joint 318 in alternating positions, as illustrated in FIG. 3A. In some embodiments, the joining of the at least two masks may be performed simultaneously.

In some embodiments, the method may further include inserting two metal wires into the folded edges of the joint multilayered fabric, using two insertion units, by a continuous provision of metal wires from two metal wire reservoirs; and placing the metal wires such that upon folding, the metal wires are located inside the folded edge. For example, two metal wires 320 may be inserted into folded edges 316 using insertion units 140. In some embodiments, each metal wire may be cut to a predetermined length, prior to the placement of metal wire.

In some embodiments, the method may further include aligning the three or more rolled fabrics prior to folding and joining, using a first aligning unit and aligning the one or more rolled materials prior to folding and joining, using a second aligning unit. For example, three or more rolled fabrics from rolls 112, 112*a* and 112*b* may be aligned using aligning unit 150 and the rolled materials may be aligned using aligning unit 155.

In some embodiments, the method may further include adding at least one pad to an inner portion of the folded open wide base of each mask, using two pad adding units. For example, pad 325 may be added to the inner portion of the folded open wide base 340 of each mask 300 using two pad adding units 160.

In some embodiments, the method may further include cutting the joint masks, using one or more cutting units. For example, masks 300 may be cut using cutting unit 170.

In some embodiments, the method may further include adding bands from both sides of each cut mask, using one or more bands connecting units located prior to the joining unit, such that upon joining each mask the bands are located between the joint fabric and the one of more folded materials and held by the joint. For example, two elastic bands 330 may be added to mask 300 using bands connecting units 180.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. An apparatus for manufacturing trapezoid-shaped masks, each mask comprising an opening along a wide base of the trapezoid and a continuous joint along two sides and a narrow base of the trapezoid, the apparatus comprising:

a first feeding unit, for providing three or more rolled fabrics;

a second feeding unit, for providing one or more rolled materials, simultaneously to the providing the three or more rolled fabrics;

a first folding and joining unit, for folding and joining together edges of three or more fabrics provided by the first feeding unit to form a joint multilayered fabric;

a second folding and joining unit, for folding and joining the edges of one or more materials provided by the second feeding unit to form folded material; and a joining unit configured to join together the joint multilayered fabric and the folded material, by forming the continuous joint, thereby forming at least two adjacent masks in relatively alternating positions, such that the open side of one mask is pointing in an opposite direction from the open side of the adjacent mask.

2. The apparatus of claim 1, further comprising:

one or more metal wire insertion units, each comprising:

a continuous metal wire reservoir containing metal wire; and a metal wire alignment unit located prior to the first and second folding and joining units, configured to place the metal wire such that upon folding the metal wire is located inside a folded edge of the material.

3. The apparatus of claim 2, further comprising:

one or more cutters for cutting the metal wire to a predetermined length during placement of metal wire.

4. The apparatus of claim 1, wherein the at least two masks are continuously joined simultaneously.

5. The apparatus of claim 1, further comprising:

a first aligning unit for aligning the three or more rolled fabrics prior to folding and joining; and a second aligning unit for aligning the one or more rolled materials prior to folding and joining.

6. The apparatus of claim 1, further comprising:

two pad adding units, configured to add at least one pad to an inner portion of the folded open wide base of each mask.

7. The apparatus of claim 1, further comprising:

one or more cutting units configured to cut the joined masks.

8. The apparatus of claim 1, further comprising;

one or more bands connecting units, configured to add bands from both sides of each cut mask, located prior to the joining unit, such that upon joining each mask the bands are located between the joint fabric and the one of more folded materials and held by the joint.

9. The apparatus of claim 1, wherein the joining unit comprises ultrasonic welding rolls, at least one being patterned with a pattern containing the continuous joints forming the at least two masks.

10. The apparatus of claim 1, wherein the joining unit comprises adhesive material providing unit for providing adhesive material to glue the joint multilayered fabric and the folded material to form the continuous joints forming the at least two masks.

11. The apparatus of claim 1, wherein the joining unit comprises sewing unit for stitching together the joint multilayered fabric and the folded material to form the continuous joint forming the at least two masks.

12. The apparatus of claim 1, wherein the joining unit comprises a stamping unit for stamping together the joint multilayered fabric and the folded material to form the continuous joint forming the at least two masks.

13. The apparatus of claim 1, wherein the joining unit comprises a press unit having at least one surface patterned with a pattern containing the continuous joint forming the at least two masks.

14. The apparatus of claim 1, wherein the three or more fabrics are selected from: nonwoven fabric and filtering fabric.

15. The apparatus of claim 1, wherein the one or more rolled material is selected from: nonwoven fabric, filtering fabric and a transparent elastomer.

16. The apparatus of claim 1, wherein the first and second feeding units are horizontally aligned one above the other.

17. The apparatus of claim 1, wherein the first and second feeding units are vertically aligned one next to the other.

18. The apparatus of claim 1, wherein the first and second feeding units are horizontally aligned, one above and one below the first and second folding and joining units.

19. The apparatus of claim 1, wherein the first and second feeding units are included in a single feeding unit.

20. A method of manufacturing trapezoid-shaped masks, each mask comprising an opening along a wide base of the trapezoid and a continuous joint along two sides and a narrow base of the trapezoid, the method comprising:

providing three or more rolled fabrics, by a first feeding unit;

providing one or more rolled materials, by a second feeding unit, simultaneously to the providing the three or more rolled fabrics;

folding and joining together edges of the three or more rolled fabrics to form a joint multilayered fabric, using a first folding and joining unit;

folding and joining the edges of the one or more rolled materials, using a second folding and joining unit to form folded material;

joining together the joint multilayered fabric and the folded material, using a joining unit, by forming the continuous joint in alternating positions, such that the open side of one mask is pointing in an opposite direction from the open side of the other mask.

* * * * *